US009146512B2

(12) United States Patent
Saito et al.

(10) Patent No.: US 9,146,512 B2
(45) Date of Patent: Sep. 29, 2015

(54) FIXING DEVICE AND IMAGE FORMING DEVICE

(71) Applicants: Kazuya Saito, Kanagawa (JP); Takeshi Uchitani, Kanagawa (JP); Takamasa Hase, Shizuoka (JP); Shuutaroh Yuasa, Kanagawa (JP); Ippei Fujimoto, Kanagawa (JP); Shinichi Namekata, Kanagawa (JP); Ryota Yamashina, Kanagawa (JP); Hiroshi Seo, Kanagawa (JP); Takumi Waida, Tokyo (JP)

(72) Inventors: Kazuya Saito, Kanagawa (JP); Takeshi Uchitani, Kanagawa (JP); Takamasa Hase, Shizuoka (JP); Shuutaroh Yuasa, Kanagawa (JP); Ippei Fujimoto, Kanagawa (JP); Shinichi Namekata, Kanagawa (JP); Ryota Yamashina, Kanagawa (JP); Hiroshi Seo, Kanagawa (JP); Takumi Waida, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 161 days.

(21) Appl. No.: 13/761,624

(22) Filed: Feb. 7, 2013

(65) Prior Publication Data

US 2013/0209128 A1 Aug. 15, 2013

(30) Foreign Application Priority Data

Feb. 9, 2012 (JP) ..... 2012-026062

(51) Int. Cl.
*G03G 15/20* (2006.01)

(52) U.S. Cl.
CPC ..... *G03G 15/2078* (2013.01); *G03G 15/2039* (2013.01); *G03G 15/2042* (2013.01); *G03G 2215/2035* (2013.01)

(58) Field of Classification Search
CPC ..... G03G 15/2078
USPC ..... 399/69
See application file for complete search history.

(56) References Cited

U.S. PATENT DOCUMENTS

| | | | |
|---|---|---|---|
| 2004/0184848 | A1 | 9/2004 | Oonishi |
| 2007/0059012 | A1 | 3/2007 | Tomine et al. |
| 2007/0212089 | A1 | 9/2007 | Seo et al. |
| 2007/0242988 | A1 | 10/2007 | Seo et al. |
| 2007/0280754 | A1 | 12/2007 | Ogawa et al. |
| 2007/0292175 | A1 | 12/2007 | Shinshi |
| 2008/0025772 | A1 | 1/2008 | Seo et al. |
| 2008/0025773 | A1 | 1/2008 | Ito et al. |
| 2008/0124147 | A1 | 5/2008 | Uehara et al. |
| 2008/0219721 | A1 | 9/2008 | Ito et al. |
| 2008/0226326 | A1 | 9/2008 | Seo et al. |
| 2008/0232873 | A1 | 9/2008 | Ueno et al. |
| 2009/0060550 | A1 | 3/2009 | Seo |

(Continued)

FOREIGN PATENT DOCUMENTS

| | | |
|---|---|---|
| JP | 2861280 | 12/1998 |
| JP | 2002-182521 | 6/2002 |

(Continued)

OTHER PUBLICATIONS

Machine translation of JP2008-139505.*

(Continued)

*Primary Examiner* — David Gray
*Assistant Examiner* — Andrew V Do
(74) *Attorney, Agent, or Firm* — Harness, Dickey & Pierce, P.L.C.

(57) ABSTRACT

When calculating an actual turn-on duty based on a required duty according to a feedback control, the actual turn-on duty is corrected using a correction table or a correction conversion formula such that a required turn-on duty and the actual turn-on duty coincide with each other. A fixing heater is controlled according to the corrected actual turn-on duty.

8 Claims, 9 Drawing Sheets

(56) References Cited

U.S. PATENT DOCUMENTS

| | | | |
|---|---|---|---|
| 2009/0148205 | A1 | 6/2009 | Seo et al. |
| 2009/0202269 | A1 | 8/2009 | Tomine et al. |
| 2009/0245897 | A1 | 10/2009 | Seo et al. |
| 2009/0297197 | A1 | 12/2009 | Hase |
| 2010/0061753 | A1 | 3/2010 | Hase |
| 2010/0092220 | A1 | 4/2010 | Hasegawa et al. |
| 2010/0092221 | A1 | 4/2010 | Shinshi et al. |
| 2010/0232822 | A1 | 9/2010 | Takenaka et al. |
| 2010/0290822 | A1 | 11/2010 | Hasegawa et al. |
| 2010/0303521 | A1 | 12/2010 | Ogawa et al. |
| 2011/0026988 | A1 | 2/2011 | Yoshikawa et al. |
| 2011/0044734 | A1 | 2/2011 | Shimokawa et al. |
| 2011/0052237 | A1 | 3/2011 | Yoshikawa et al. |
| 2011/0052245 | A1 | 3/2011 | Shinshi et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064437 | A1 | 3/2011 | Yamashina et al. |
| 2011/0064443 | A1 | 3/2011 | Iwaya et al. |
| 2011/0064502 | A1 | 3/2011 | Hase et al. |
| 2011/0076071 | A1 | 3/2011 | Yamaguchi et al. |
| 2011/0085832 | A1 | 4/2011 | Hasegawa et al. |
| 2011/0091253 | A1 | 4/2011 | Seo et al. |
| 2011/0116848 | A1 | 5/2011 | Yamaguchi et al. |
| 2011/0129268 | A1 | 6/2011 | Ishii et al. |
| 2011/0142472 | A1* | 6/2011 | Mitsuoka et al. ..... 399/69 |
| 2011/0150518 | A1 | 6/2011 | Hase et al. |
| 2011/0170917 | A1 | 7/2011 | Yoshikawa et al. |
| 2011/0176821 | A1 | 7/2011 | Hase |
| 2011/0182634 | A1 | 7/2011 | Ishigaya et al. |
| 2011/0182638 | A1 | 7/2011 | Ishii et al. |
| 2011/0194869 | A1 | 8/2011 | Yoshinaga et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206402 | A1 | 8/2011 | Yamashina |
| 2011/0206427 | A1 | 8/2011 | Iwaya et al. |
| 2011/0211876 | A1 | 9/2011 | Iwaya et al. |
| 2011/0217056 | A1 | 9/2011 | Yoshinaga et al. |
| 2011/0217057 | A1 | 9/2011 | Yoshinaga et al. |
| 2011/0217093 | A1 | 9/2011 | Tokuda et al. |
| 2011/0217095 | A1 | 9/2011 | Ishii et al. |
| 2011/0222875 | A1 | 9/2011 | Imada et al. |
| 2011/0222876 | A1 | 9/2011 | Yuasa et al. |
| 2011/0222888 | A1 | 9/2011 | Ikebuchi et al. |
| 2011/0222926 | A1 | 9/2011 | Ueno et al. |
| 2011/0222927 | A1 | 9/2011 | Yamashina |
| 2011/0222929 | A1 | 9/2011 | Fujimoto et al. |
| 2011/0222930 | A1 | 9/2011 | Fujimoto et al. |
| 2011/0222931 | A1 | 9/2011 | Shinshi et al. |
| 2011/0229161 | A1 | 9/2011 | Ueno et al. |
| 2011/0229162 | A1 | 9/2011 | Ogawa et al. |
| 2011/0229178 | A1 | 9/2011 | Ogawa et al. |
| 2011/0229181 | A1 | 9/2011 | Iwaya et al. |
| 2011/0229200 | A1 | 9/2011 | Yamaguchi et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |
| 2011/0274453 | A1 | 11/2011 | Shimokawa et al. |
| 2011/0293309 | A1 | 12/2011 | Hase |
| 2011/0311284 | A1 | 12/2011 | Seo et al. |
| 2012/0045226 | A1 | 2/2012 | Hase et al. |
| 2012/0051766 | A1 | 3/2012 | Ueno et al. |
| 2012/0051774 | A1 | 3/2012 | Ikebuchi et al. |
| 2012/0093531 | A1 | 4/2012 | Yuasa et al. |
| 2012/0093532 | A1 | 4/2012 | Ishigaya et al. |
| 2012/0093534 | A1 | 4/2012 | Waida et al. |
| 2012/0093551 | A1 | 4/2012 | Ogawa et al. |
| 2012/0107005 | A1 | 5/2012 | Hase et al. |
| 2012/0114345 | A1 | 5/2012 | Fujimoto et al. |
| 2012/0114354 | A1 | 5/2012 | Saito et al. |
| 2012/0121303 | A1 | 5/2012 | Takagi et al. |
| 2012/0121304 | A1 | 5/2012 | Tokuda et al. |
| 2012/0121305 | A1 | 5/2012 | Yoshikawa et al. |
| 2012/0148303 | A1 | 6/2012 | Yamaguchi et al. |
| 2012/0155935 | A1 | 6/2012 | Yoshikawa et al. |
| 2012/0155936 | A1 | 6/2012 | Yamaguchi et al. |
| 2012/0177388 | A1 | 7/2012 | Imada et al. |
| 2012/0177393 | A1 | 7/2012 | Ikebuchi et al. |
| 2012/0177420 | A1 | 7/2012 | Shimokawa et al. |
| 2012/0177423 | A1 | 7/2012 | Imada et al. |
| 2012/0177424 | A1 | 7/2012 | Saito et al. |
| 2012/0207502 | A1 | 8/2012 | Seo |
| 2012/0207523 | A1 | 8/2012 | Ueno et al. |
| 2012/0219312 | A1 | 8/2012 | Yuasa et al. |
| 2012/0224878 | A1 | 9/2012 | Ikebuchi et al. |
| 2012/0237273 | A1 | 9/2012 | Yoshinaga et al. |
| 2012/0301161 | A1 | 11/2012 | Fujimoto |

FOREIGN PATENT DOCUMENTS

| | | | |
|---|---|---|---|
| JP | 2004-094146 | | 3/2004 |
| JP | 2004-286922 | | 10/2004 |
| JP | 2007-079040 | | 3/2007 |
| JP | 2007-334205 | | 12/2007 |
| JP | 2008-070686 | | 3/2008 |
| JP | 2008-129517 | | 6/2008 |
| JP | 2008-139505 | | 6/2008 |
| JP | 2008139505 | A * | 6/2008 |
| JP | 2010-026256 | | 2/2010 |
| JP | 2010-032625 | | 2/2010 |
| JP | 2010-078839 | | 4/2010 |
| JP | 2010-096782 | | 4/2010 |
| JP | 2010-217257 | | 9/2010 |
| JP | 4742165 | | 5/2011 |
| JP | 2011-180220 | | 9/2011 |
| JP | 4875385 | | 12/2011 |

OTHER PUBLICATIONS

U.S. Appl. No. 13/557,841, filed Jul. 25, 2012, Toshihiko Shimokawa.

* cited by examiner

FIXING DEVICE AND IMAGE FORMING DEVICE

CROSS-REFERENCE TO RELATED APPLICATIONS

The present application claims priority to and incorporates by reference the entire contents of Japanese Patent Application No. 2012-026062 filed in Japan on Feb. 9, 2012.

BACKGROUND OF THE INVENTION

1. Field of the Invention

The present invention relates to a fixing device for fixing an image on a recording medium, and an image forming device including the fixing device.

2. Description of the Related Art

In an image forming device such as a copier, a printer, a fax machine, or an MFP having a function of these devices, and the like, a copied matter and a recorded matter may be obtained by heating and fixing an unfixed image that is transferred and is being carried on a recording medium such as a sheet of paper.

In the fixing process, a developer, in particular, toner included in an unfixed image is melted and softened and penetrated into a recording medium by heating the unfixed image carried by the recording medium while sandwiching and conveying the recording medium by a fixing member and a pressing member, thereby the toner is fixed onto the recording medium.

As a fixing heater control method, a soft start/stop control is conventionally known, and is described in Japanese Patent Application Laid-open No. 2002-182521. In a soft start control, in order to limit the inrush current at the initial time period after turning on the heater, the turn-on period of heater is gradually increased, and once the filament of the heater is heated up to a certain degree, the heater starts to be controlled such that the turn-on period of heater is maintained constant. On the other hand, in a soft stop control, the turn-off period of heater is gradually increased before finally turning off the heater. The soft start and the soft stop are together called the soft start/stop control. The soft start/stop control also includes, instead of the increasing of the turn-on/turn-off period of heater, gradual narrowing of interval between the turn-on period and the turn-off period with both periods held constant.

Now, at the time of heating a fixing member up to a predetermined temperature by a heat source, if the heating time up to the predetermined temperature is sufficiently short, omitting a preheating step in a standby state can significantly reduce energy consumption without greatly affecting the usability of a user. To achieve this point, in recent years, a low heat capacity member, such as a thin roller, a thin belt formed from a metal base and an elastic rubber layer, or the like is increasingly being used as the fixing member. Also, with respect to a heat source, rapid heating is realized by using, besides a halogen heater that heats a fixing member by radiation heat, a ceramic heater, an IH method with high heating efficiency or the like. Fixing devices having such structures are disclosed in Japanese Patent Application Laid-open No. 2007-79040, Japanese Patent Application Laid-open No. 2010-32625, Japanese Patent Application Laid-open No. 2007-334205 and Japanese Patent Application Laid-open No. 2008-129517, for example.

With a fixing device that uses a fixing member of a low heat capacity as described above, the amount of heat stored in the fixing member is small, and thus, the temperature of the surface of the fixing member is easily changed at the time of fixing the toner. That is, the heater turn-on state at the instant of a sheet of paper passing through is likely to reflect the temperature state of the fixing member. Accordingly, the difference between a required duty of a heater according to a soft start/stop and an actual turn-on duty which is allowed in a conventional fixing device may not be allowed (in a fixing device which uses the fixing member of a low heat capacity), and there is a problem of poor fixation such as a cold offset, a hot offset or the like. Meanwhile, in the present specification, "duty ratio" will be referred to as "duty".

Furthermore, there is also a problem that, because the required duty, which is obtained by means of duty calculation based on the temperature information of a fixing member detected by a temperature detection unit, and the actual turn-on duty are different, if an amount of heat generation in the actual turning-on is too much, the temperature may rise until a safety device activates. Once the safety device activates, it cannot be deactivated by a user, and a service man has to be called, which results in downtime and lowered productivity.

Therefore, there is a need for a fixing device and an image forming device including the fixing device that are capable of maintaining an appropriate state where poor fixation does not occur even when a soft start/stop control is performed and where temperature can be prevented from getting out of control.

SUMMARY OF THE INVENTION

According to an embodiment, there is provided a fixing device for conveying a recording medium carrying an unfixed image and fixing the unfixed image on the recording medium. The fixing device includes a rotatable fixing member; a rotatable pressing member that is in press contact with the fixing member to form a nip portion; a heat source that heats the fixing member; a temperature detection unit that detects a temperature of the fixing member; and a temperature control unit configured to control power supply to the heat source based on temperature information input from the temperature detection unit. The temperature control unit is configured to control turn-on period of the heat source at an initial time period after start of the power supply and at an ending time period before end of the power supply to gradually change a temperature of the fixing member. The fixing device has a correction table or a correction conversion formula to correct a difference between a necessary amount of heat and an actual amount of heat. The necessary amount of heat is an amount of heat necessary, according to calculation, for controlling the fixing member to be a predetermined temperature. The actual amount of heat is an amount of heat in actually turning on the heat source according to the control of the turn-on period of the heat source to thereby gradually change the temperature of the fixing device. The temperature control unit is configured to correct, using the correction table or the correction conversion formula, the actual amount of heat or an actual turn-on duty in such a manner that the actual amount of heat or the actual turn-on duty coincides with a required amount of heat or a required turn-on duty that is calculated based on the temperature information, to thereby perform the control of power supply to the heat source according to the corrected actual amount of heat or the corrected actual turn-on duty.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
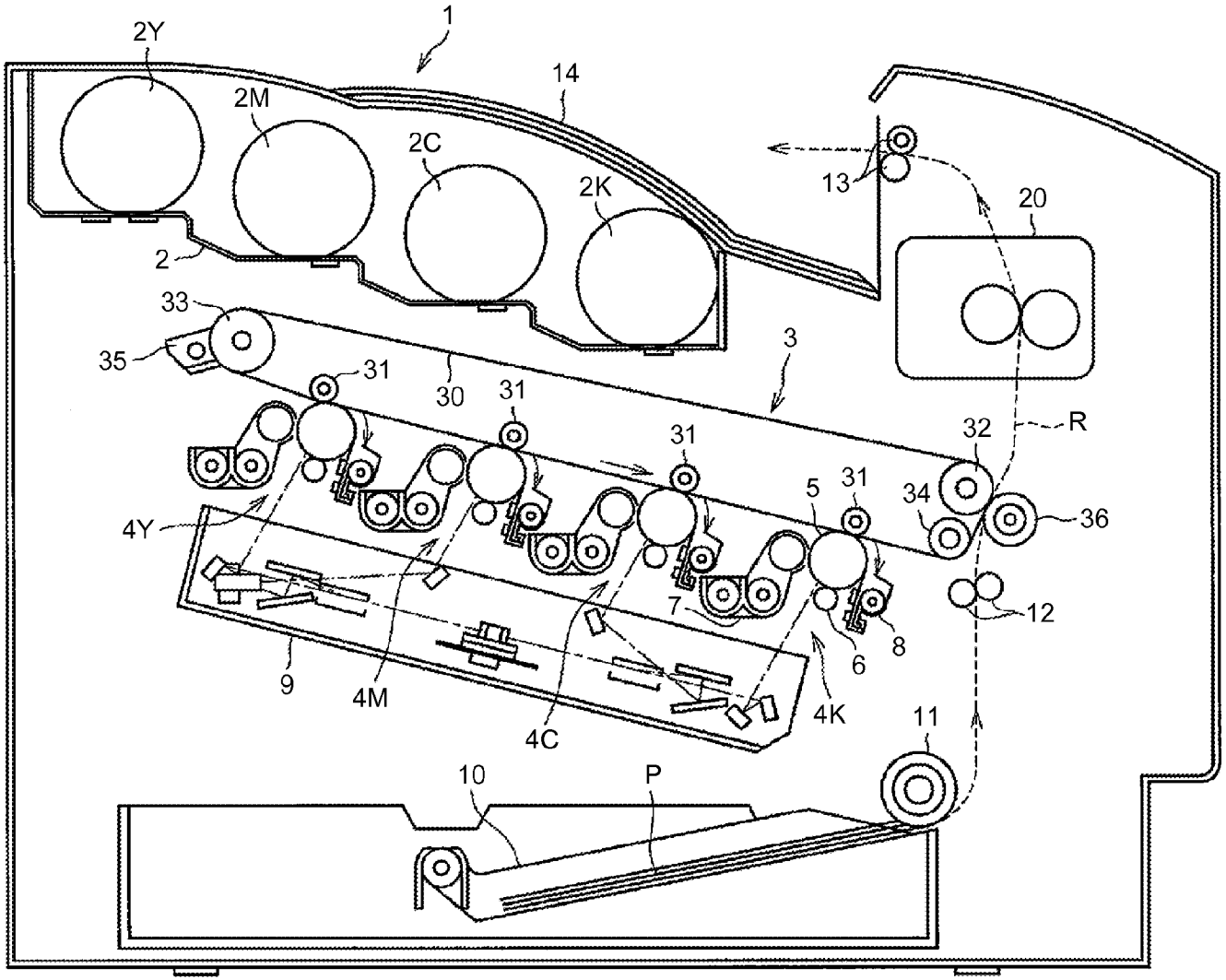
FIG. 1 is a schematic configuration diagram illustrating an embodiment of an image forming device according to the present invention.

Hereinafter, embodiments of the present invention will be described with reference to the appended drawings. Note that, in the respective drawings used for describing the embodiments of the present invention, structural elements, such as members or structural components, having the same function or the same shape are denoted by the same reference numerals as long as identification is possible, and repeated explanation thereof is omitted.

First, an overall configuration and an operation of an image forming device according to an embodiment of the present invention will be described with reference to FIG. 1.

An image forming device 1 illustrated in FIG. 1 is a tandem color laser printer, and four image forming units 4Y, 4M, 4C and 4K are provided at the center of the device main body. The image forming units 4Y, 4M, 4C and 4K are configured in the same manner except in that they each contain a developer of a different color among yellow (Y), magenta (M), cyan (C) and black (K) corresponding to color separation components of a color image.

Specifically, each of the image forming units 4Y, 4M, 4C and 4K includes a drum photosensitive element 5 as a latent image carrier, a charging device 6 for charging the surface of the photosensitive element 5, a developing device 7 for supplying toner to the surface of the photosensitive element 5, a cleaning device 8 for cleaning the surface of the photosensitive element 5, and the like. Additionally, in FIG. 1, only the photosensitive element 5, the charging device 6, the developing device 7 and the cleaning device 8 of the black image forming unit 4K are denoted with reference numerals, and the reference numerals are omitted with respect to the image forming units 4Y, 4M and 4C.

An exposing device 9 for exposing the surface of the photosensitive element 5 is arranged below the image forming units 4Y, 4M, 4C and 4K. The exposing device 9 includes a light source, a polygon mirror, an f-θ lens, a reflecting mirror or the like, and emits laser light on the surface of each photosensitive element 5 based on image data.

A transfer device 3 is arranged above the image forming units 4Y, 4M, 4C and 4K. The transfer device 3 includes an intermediate transfer belt 30 as a transfer body, four primary transfer rollers 31 as primary transfer units, a secondary transfer roller 36 as a secondary transfer unit, a secondary transfer backup roller 32, a cleaning backup roller 33, a tension roller 34, and a belt cleaning device 35.

The intermediate transfer belt 30 is an endless belt, and is extended over the secondary transfer backup roller 32, the cleaning backup roller 33 and the tension roller 34. Here, when the secondary transfer backup roller 32 is rotated, the intermediate transfer belt 30 travels around (rotates) in the direction shown by the arrow in the drawing.

Each of the four primary transfer rollers 31 sandwiches the intermediate transfer belt 30 with the photosensitive element 5, and forms a primary transfer nip. Also, a power source, not illustrated, is connected to each primary transfer roller 31, and a predetermined DC voltage (DC) and/or alternating voltage (AC) is applied to each primary transfer roller 31.

The secondary transfer roller 36 sandwiches the intermediate transfer belt 30 with the secondary transfer backup roller 32, and forms a secondary transfer nip. Furthermore, like the primary transfer roller 31, a power source, not illustrated, is also connected to the secondary transfer roller 36, and a predetermined DC voltage (DC) and/or alternating voltage (AC) is applied to the secondary transfer roller 36.

The belt cleaning device 35 includes a cleaning brush and a cleaning blade that are arranged to abut the intermediate transfer belt 30. A waste toner transport hose, not illustrated, extending from the belt cleaning device 35 is connected to an inlet port of a waste toner container, not illustrated.

A bottle housing 2 is provided on the upper part of the printer main body, and four toner bottles 2Y, 2M, 2C and 2K containing toner for replenishment are installed in the bottle housing 2 in an attachable/detachable manner. A replenishing path, not illustrated, is provided between each toner bottle 2Y, 2M, 2C or 2K and each developing device 7, and toner is replenished from each toner bottle 2Y, 2M, 2C or 2K to each developing device 7 through the replenishing path.

On the lower part of the printer main body, a paper feed tray 10 containing sheets of paper P as recording media, a paper feed roller 11 for carrying out the sheets of paper P from the paper feed tray 10, and the like are provided. Here, the recording media include, besides plain paper, cardboards, postcards, envelopes, thin paper, coated paper (coat paper, art paper and the like), tracing paper, OHP sheets and the like. Also, although not illustrated, a manual feeding mechanism may be provided.

Inside the printer main body, a conveying path R for ejecting the sheets of paper P outside the device from the paper feed tray 10 through the secondary transfer nip is arranged. In the conveying path R, a pair of registration rollers 12, as conveying units, for conveying the sheet of paper P to the secondary transfer nip is arranged on the upstream, of the position of the secondary transfer roller 36, in the paper conveying direction.

Also, on the downstream, of the position of the secondary transfer roller 36, in the paper conveying direction, a fixing device 20 for fixing a non-fixed image transferred on a sheet of paper P is arranged. Furthermore, on the downstream, of the fixing device 20, in the paper conveying direction of the conveying path R, a pair of discharging rollers 13 for ejecting the sheet of paper outside the device is provided. Also, on the upper surface of the printer main body, a discharge tray 14 for stocking sheets of paper ejected outside the device is provided.

Next, a basic operation of the printer according to the present embodiment will be described with reference to FIG. 1.

When an image forming operation is started, the photosensitive elements 5 of the image forming units 4Y, 4M, 4C and 4K are rotated clockwise on the page by a driving device, not illustrated, and the surfaces of the photosensitive elements 5 are uniformly charged by the charging devices 6 to a predetermined polarity. Laser light is emitted by the exposing device 9 on the surfaces of the charged photosensitive elements 5, and an electrostatic latent image is formed on the surface of each photosensitive element 5. At this time, image information exposed on each photosensitive element 5 is single color image information obtained by separating a desired full color image into color information yellow, magenta, cyan and black. When toner is supplied by the developing devices 7 to the electrostatic latent images formed on the photosensitive elements 5, the electrostatic latent images are visualized as toner images (i.e. formed as visible images).

Also, when the image forming operation is started, the secondary transfer backup roller 32 is rotated counterclockwise on the page, and causes the intermediate transfer belt 30 to travel around in the direction shown by the arrow in the drawing. Then, a voltage of a polarity opposite the charging polarity of the toner or a constant current controlled voltage is applied to each primary transfer roller 31. A transfer electric field is thereby formed at the primary transfer nip between each primary transfer roller 31 and each photosensitive element 5.

Then, when the toner images of respective colors on the photosensitive elements 5 have reached the primary transfer nips by the rotation of the photosensitive elements 5, the toner images on the photosensitive elements 5 are sequentially superimposed on the intermediate transfer belt 30 and transferred by the transfer electric fields formed at the primary transfer nips. A full color toner image is thus carried on the surface of the intermediate transfer belt 30. Also, the toner on the photosensitive element 5 which did not transfer to the intermediate transfer belt 30 is removed by the cleaning device 8. Then, the surface of each photosensitive element 5 is neutralized by a neutralization device, not illustrated, and the surface potential is initialized.

At the lower part of the image forming device, the paper feed roller 11 starts rotating, and a sheet of paper P is sent out from the paper feed tray 10 to the conveying path R. The sheet of paper P sent out to the conveying path R is sent to the secondary transfer nip between the secondary transfer roller 36 and the secondary transfer backup roller 32 at a timing determined by the registration rollers 12. Here, a transfer voltage of a polarity opposite the toner charging polarity of the toner image on the intermediate transfer belt 30 is applied to the secondary transfer roller 36, and a transfer electric field is thereby formed at the secondary transfer nip.

Then, when the toner image on the intermediate transfer belt 30 reaches the secondary transfer nip by the round travelling of the intermediate transfer belt 30, the toner images on the intermediate transfer belt 30 are collectively transferred onto a sheet of paper P by the transfer electric field formed at the secondary transfer nip. Also, residual toner on the intermediate transfer belt 30 which was not transferred onto the sheet of paper P is removed by the belt cleaning device 35, and the toner which has been removed is conveyed to, and collected at, a waste toner container not illustrated.

Then, the sheet of paper P is conveyed to the fixing device 20, and the toner image on the sheet of paper P is fixed by the fixing device 20 on the sheet of paper P. Then, the sheet of paper P is ejected outside the device by the discharging rollers 13, and is stocked on the discharge tray 14.

The description given above relates to an image forming operation at the time of forming a full color image on a sheet of paper, but it is also possible to form a single color image by using one of the four image forming units 4Y, 4M, 4C and 4K, or an image in two or three colors by using two or three image forming units.

Next, a configuration of the fixing device 20 will be described with reference to FIG. 2.

Figure 2:
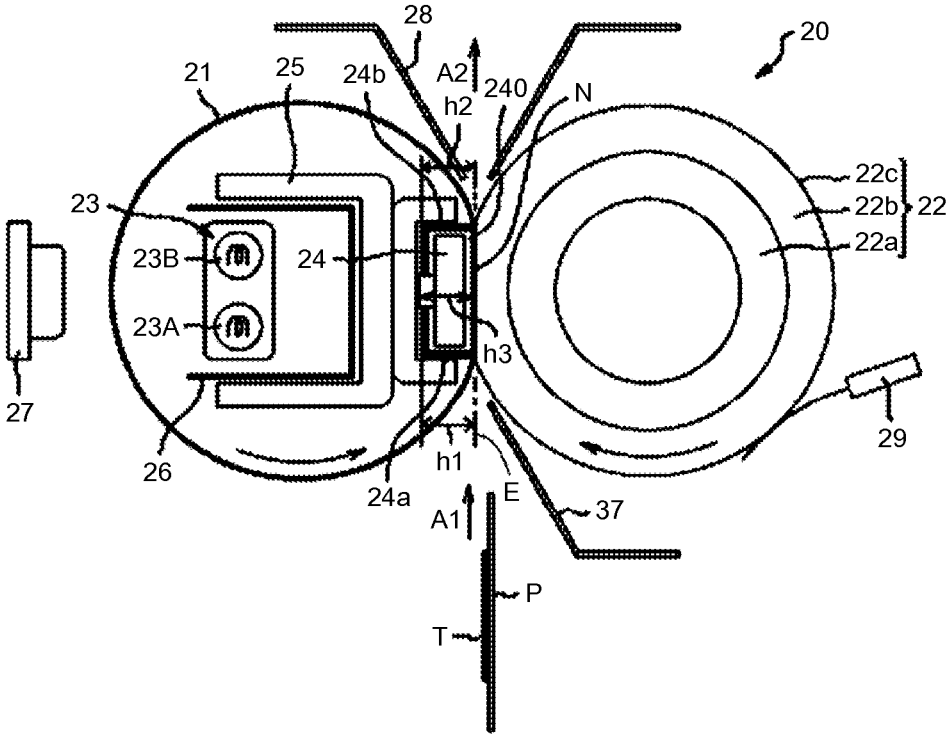
FIG. 2 is a schematic configuration diagram of a fixing device installed in the image forming device.

As illustrated in FIG. 2, the fixing device 20 includes a fixing belt 21 as a rotatable fixing member, a pressing roller 22, as a pressing member, provided in a rotatable manner facing the fixing belt 21, a halogen heater 23 as a heat source for heating the fixing belt 21, a nip forming member 24 and a stay 25 as support members arranged on the inside of the fixing belt 21, a reflecting member 26 for reflecting light emitted from the halogen heater 23 to the fixing belt 21, a thermopile 27 as a temperature detection unit for detecting the temperature of the fixing belt 21, a thermistor 29 as a temperature detection unit for detecting the temperature of the pressing roller 22, a separating member 28 for separating paper from the fixing belt 21, a pressing unit, not illustrated, for pressing the pressing roller 22 against the fixing belt 21, and the like.

The fixing belt 21 is formed from an endless belt member (including film) which is thin and flexible. More particularly, the fixing belt 21 is formed from a base member on the inner circumferential side formed of a metal material such as nickel, SUS or the like, or a resin material such as polyimide (PI) or the like, and a release layer on the outer circumferential side formed of Tetrafluoroetylene-Perfluoroalkylvinylether Copolymer (PFA), polytetrafluoroethylene (PTFE) or the like. An elastic layer formed of a rubber material such as silicone rubber, foamed silicone rubber, fluoro rubber or the like may also be interposed between the base member and the release layer.

The pressing roller 22 is formed from a mandrel 22*a*, an elastic layer 22*b* formed of foamed silicone rubber, silicone rubber, fluoro rubber or the like provided on the surface of the mandrel 22*a*, and a release layer 22*c* formed of PFA, PTFE or the like provided on the surface of the elastic layer 22*b*. The pressing roller 22 is pressed against the fixing belt 21 by a pressing unit, not illustrated, and abuts the nip forming member 24 via the fixing belt 21. A nip portion N of a predetermined width is formed at a position where the pressing roller 22 and the fixing belt 21 are pressed against each other, by the elastic layer 22*b* of the pressing roller 22 being flattened. Moreover, the pressing roller 22 is configured to be rotated by a driving source such as a motor, not illustrated, provided to the printer main body. When the pressing roller 22 is rotated, a driving force is transmitted to the fixing belt 21 at the nip portion N, and the fixing belt 21 is rotated.

In the present embodiment, the pressing roller 22 is a hollow roller, but it may also be a solid roller. Also, a heat source, such as a halogen heater or the like, may be arranged inside the pressing roller 22. Also, in the case there is no elastic layer, the heat capacity is reduced and the fixedness is improved, but subtle unevenness on the belt surface may be transferred to the image at the time of pressing and fixing the non-fixed toner, and unevenness in gloss may occur in a solid part of the image. To prevent this, it is desirable to provide the elastic layer. The subtle unevenness can be absorbed by the elastic deformation of the elastic layer, and the occurrence of the unevenness in gloss can be prevented. The elastic layer 22*b* may be solid rubber, but sponge rubber may also be used in the case there is no heat source inside the pressing roller 22. The sponge rubber is more desirable because it provides better thermal insulation and the heat of the fixing belt 21 is less likely to be lost. Furthermore, the fixing member and the pressing member do not necessarily have to be pressed against each other, and a configuration where they are simply in contact with each other with no pressure applied thereon is also possible.

In the present embodiment, the halogen heater 23 is composed of two halogen heaters 23A and 23B, and each halogen heater 23A or 23B has its both ends fixed to side plates (not illustrated) of the fixing device 20. Each of the halogen heater 23A and 23B is configured to generate heat according to output control by a power supply unit provided to the printer main body, and the output control is performed based on the detection result for the surface temperature of the fixing belt 21 by the thermopile 27. The temperature of the fixing belt 21 (the fixing temperature) can be set to a desired temperature by such output control of the heaters 23A and 23B. Additionally, the heat source for heating the fixing belt 21 may be a heat generator other than the halogen heater, such as a ceramic heater or a heater that uses the IH method, for example.

The nip forming member 24 is longitudinally arranged in the axial direction of the fixing belt 21 or the axial direction of the pressing roller 22, and is fixed and supported by the stay 25. Accordingly, the pressure from the pressing roller 22 is supported and the nip forming member 24 is prevented from bending, and a uniform nip width can be obtained along the axial direction of the pressing roller 22. Additionally, to achieve the function of preventing the nip forming member 24 from bending, the stay 25 is desirably formed of a metal material having high mechanical strength, such as steel or iron. Also, by forming the stay 25 to have a horizontally long cross section extending in the pressure direction of the pressing roller 22, the section modulus increases, and the mechanical strength of the stay 25 can be increased.

Furthermore, the nip forming member 24 is formed from a heat-resistant member whose heat-resistant temperature is 200 degrees or higher. Deformation of the nip forming member 24 by heat is thereby prevented in the toner fixing temperature range and the nip portion N is maintained in a stable state to achieve stable output image quality. Common heat-resistant resin may be used for the nip forming member 24, such as poly ether sulphone (PES), polyphenylene sulfide (PPS), liquid crystal polymer (LCP), polyether nitrile (PEN), polyamide-imide (PAI), polyether ether ketone (PEEK) or the like.

Furthermore, the nip forming member 24 has a low friction sheet 240 provided on its surface. At the time of rotation of the fixing belt 21, the fixing belt 21 slides on the low friction sheet 240, and thus, the driving torque on the fixing belt 21 is reduced and the load on the fixing belt 21 due to the frictional force is reduced.

The reflecting member 26 is arranged between the stay 25 and the halogen heater 23. By arranging the reflecting member 26 in this manner, the light emitted from the halogen heater 23 toward the stay 25 is reflected to the fixing belt 21. The amount of light emitted on the fixing belt 21 can thereby be increased, and the fixing belt 21 can be efficiently heated. Also, radiant heat from the halogen heater 23 can be prevented from being transmitted to the stay 25 and the like, and energy can be saved.

Furthermore, the fixing device 20 according to the present embodiment is structurally modified in many ways so as to further save energy and to reduce the first print output time, for example.

Specifically, the fixing belt 21 is allowed to be directly heated by the halogen heater 23 at positions other than the nip portion N (a direct heating method). In the present embodiment, nothing is interposed between the halogen heater 23 and the left side in FIG. 2 of the fixing belt 21, and the radiant heat from the halogen heater 23 is directly applied to the fixing belt 21 at the position.

Furthermore, to reduce the heat capacity of the fixing belt 21, the fixing belt 21 is made thin, and also, its diameter is reduced. Specifically, the thicknesses of the base member, the elastic layer and the release layer forming the fixing belt 21 are set to within ranges of, for example, 20 to 50 μm, 100 to 300 μm and 10 to 50 μm, respectively, and the overall thickness is set to 1 mm or less. Also, the diameter of the fixing belt 21 is set to 20 to 40 mm. To further reduce the heat capacity, the thickness of the whole fixing belt 21 is preferably 0.2 mm or less, and more preferably, 0.16 mm or less. Also, the diameter of the fixing belt 21 is preferably 30 mm or less.

Note that, in the present embodiment, the diameter of the pressing roller 22 is set to 20 to 40 mm, and the diameter of the fixing belt 21 and the diameter of the pressing roller 22 are made to be the same. However, this structure is not restrictive. For example, the diameter of the fixing belt 21 may be formed to be smaller than the diameter of the pressing roller 22. In this case, since the curvature of the fixing belt 21 is smaller than the curvature of the pressing roller 22 at the nip portion N, a recording medium ejected from the nip portion N is easily separated from the fixing belt 21.

Moreover, as a result of reducing the diameter of the fixing belt 21 as described above, the inner space of the fixing belt 21 is reduced, but in the present embodiment, by forming the stay 25 into a concave shape by bending its both ends and accommodating the halogen heater 23 inside the concave shape, arrangement of the stay 25 and the halogen heater 23 in a small space is enabled.

Moreover, to allow the stay 25 to be arranged as largely as possible in a small space, the nip forming member 24 is, in contrast, formed to be compact. Specifically, the width of the nip forming member 24 in the sheet conveying direction is formed to be less than the width of the stay 25 in the sheet conveying direction. Moreover, in FIG. 2, when heights at an upstream end portion 24*a* and a downstream end portion 24*b* of the nip forming member 24 in the sheet conveying direction with respect to the nip portion N (or a virtual extended line E) are given as h1 and h2, and maximum height of parts other than the upstream end portion 24*a* and the downstream end portion 24*b* of the nip forming member 24 with respect to the nip portion N (or the virtual extended line E) is given as h3, h1≤h3 and h2≤h3 are to be true. With this structure, the upstream end portion 24*a* and the downstream end portion 24*b* of the nip forming member 24 are not interposed between the fixing belt 21 and each of bent portions of the stay 25 at the upstream side and the downstream side in the sheet conveying direction, and the bent portions may be arranged close to the inner circumferential surface of the fixing belt 21. This allows the stay 25 to be arranged as largely as possible in the limited space within the fixing belt 21, and the strength of the stay 25 may be maintained. As a result, bending of the nip forming member 24 by the pressing roller 22 can be prevented, and the fixedness can be improved.

In the following, a basic operation of the fixing device according to the present embodiment will be described with reference to FIG. 2.

When the power switch of the printer main body is turned on, power is supplied to the halogen heater 23, and also, the pressing roller 22 starts to rotate clockwise in FIG. 2. The fixing belt 21 is then caused to rotate counterclockwise in accordance with the rotation of the pressing roller 22 in FIG. 2, by the friction force between the fixing belt 21 and the pressing roller 22.

Then, a sheet of paper P which is made to carry a non-fixed toner image T by the image forming process described above is guided by a guide plate 37 and is conveyed in the direction of arrow A1 in FIG. 2, and is sent to the nip portion N of the fixing belt 21 and the pressing roller 22 that are pressed against each other. Then, the toner image T is fixed on the surface of the sheet of paper P by the heat of the fixing belt 21 heated by the halogen heater 23 and the pressure between the fixing belt 21 and the pressing roller 22.

The sheet of paper P on which the toner image T is fixed is carried out from the nip portion N in the direction of arrow A2 in FIG. 2. At this time, the tip of the sheet of paper P contacts the tip of the separating member 28, and the sheet of paper P is separated from the fixing belt 21. Then, the sheet of paper P which has been separated is discharged outside the device by the discharging roller and is stocked in the discharge tray, as described above.

Figure 3:
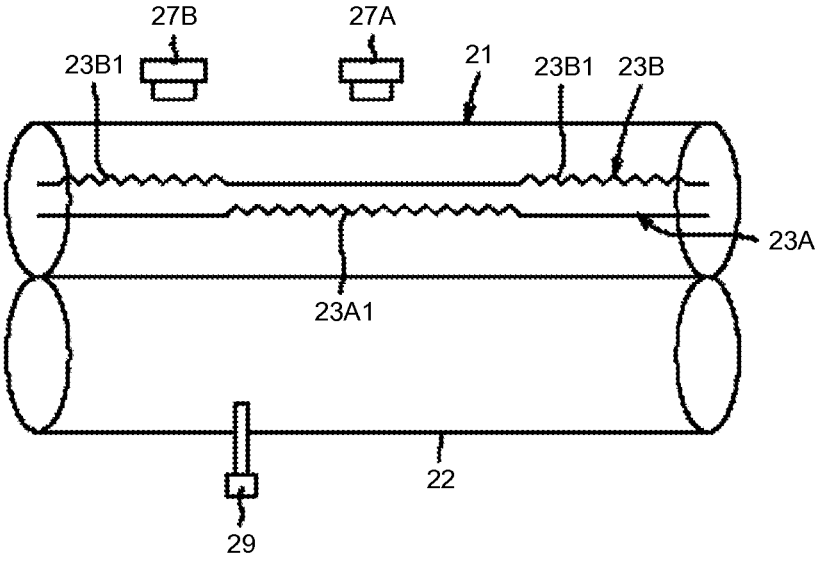
FIG. 3 is a diagram conceptually illustrating a heat source (a halogen heater) and a temperature detection unit (a thermopile, a thermistor) of the fixing device.

FIG. 3 is a schematic diagram for describing heat distribution and the like of the halogen heater 23.

The halogen heater 23A on the lower side in FIG. 3 is given as a first halogen heater, and the halogen heater 23B on the upper side is given as a second halogen heater, and the position of a heat generation portion is different for the first halogen heater 23A and the second halogen heater 23B.

Specifically, the first halogen heater 23A includes a heat generation portion (a light emitting portion) 23A1 which is arranged over a predetermined range from a center portion in the longitudinal direction. In the present embodiment, the heat generation portion 23A1 is provided in a range of 200 to 220 mm with the center portion of the first halogen heater 23A in the longitudinal direction as the axis of symmetry.

The second halogen heater 23B includes a heat generation portion (a light emitting portion) 23B1 at each of end portions in the longitudinal direction. In the present embodiment, the heat generation portions 23B1 are provided in ranges from the position of 200 to 220 mm to the position of 300 to 330 mm with the center portion of the second halogen heater 23B in the longitudinal direction as the axis of symmetry. Now, the paper passage width of an A3 size sheet of paper or the long side of an A4 size sheet of paper is 297 mm, and the total of the length of the heat generation portion 23A1 positioned at the center of the first halogen heater 23A and the lengths of the heat generation portions 23B1 positioned at both ends of the second halogen heater 23B is 300 to 330 mm and is more than the paper passage width mentioned above. This is because the amount of heat generation is small (the light emission intensity is weak) at the outer end portions of the heat generation portions 23B1, resulting in a temperature drop, and a paper passage area has to use a part where the amount of heat generation (the light emission intensity) is a predetermined amount or more.

In the present embodiment, two thermopiles 27A and 27B for detecting the temperature of the fixing belt 21 are provided. In FIG. 3, the thermopile 27A on the right is given as a first thermopile and the thermopile 27B on the left is given as a second thermopile, and the first thermopile 27A is installed corresponding to the heat generation portion 23A1 of the first halogen heater 23A to detect the temperature at a middle region of the fixing belt 21, and the second thermopile 27B is installed corresponding to the heat generation portion 23B1 of the second halogen heater 23B to detect the temperature of an end region of the fixing belt 21.

Figure 4:
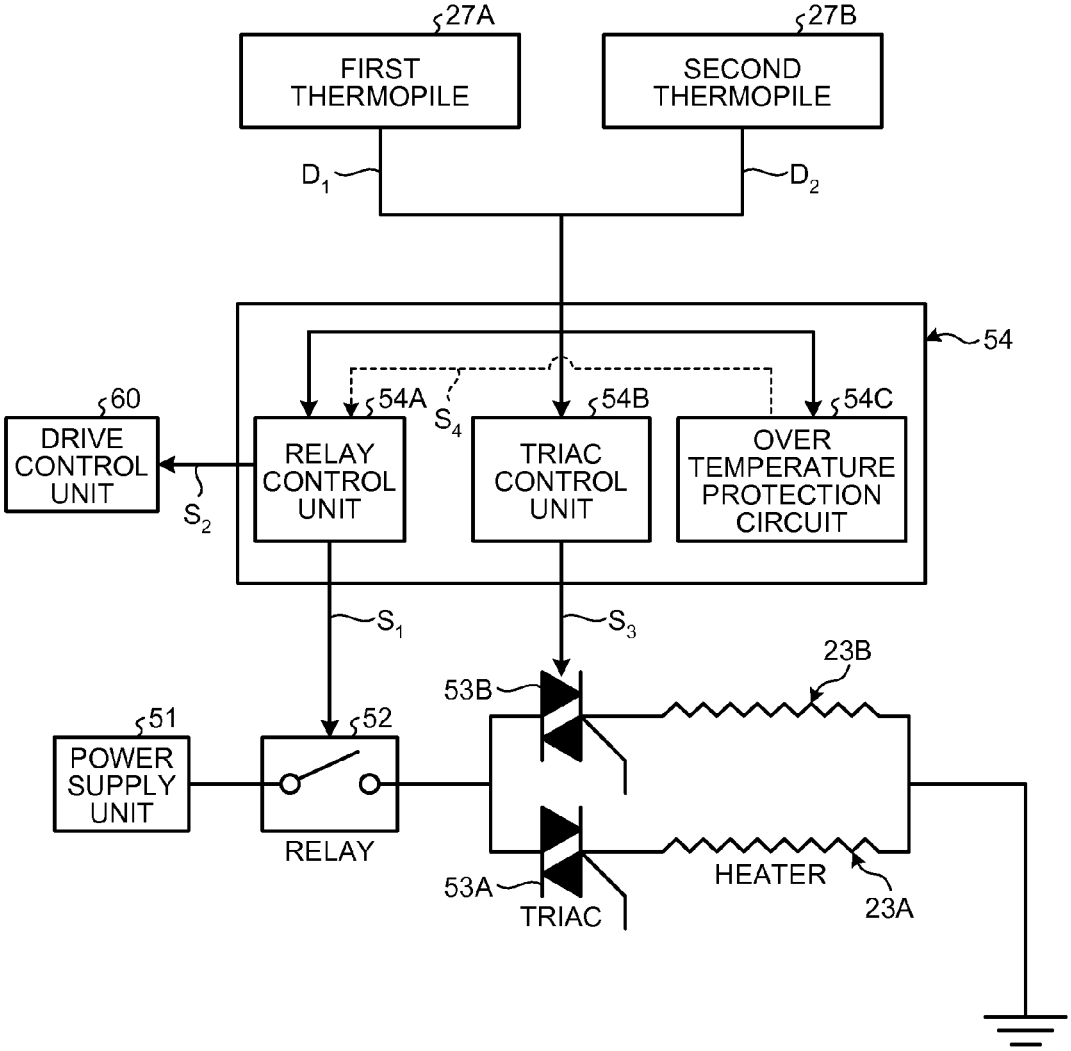
FIG. 4 is a diagram illustrating a temperature control circuit of the fixing device.

FIG. 4 shows an example configuration of a temperature control circuit of the fixing device 20. Power supplied from a power supply unit 51 is supplied to the halogen heaters 23A and 23B via a relay 52 and triacs 53A and 53B. The relay 52 is turned on (closed) at the time of warm-up, print job execution, ready/stand-by and the like, but is turned off (opened) in other situations such as when power is off, when in off-mode or energy saving mode, or at the time of sudden stop. The triacs 53A and 53B control the amount of current flow to the first halogen heater 23A and the second halogen heater 23B, feed back pieces of temperature information of the fixing belt 21 detected by the first thermopile 27A and the second thermopile 27B, and maintain the fixing belt 21 at a predetermined temperature.

A temperature control unit 54 includes a relay control unit 54A for controlling the relay 52; a triac control unit 54B for controlling the triacs 53A and 53B; and an over temperature protection circuit 54C for outputting an abnormal stop signal at the time belt 21. Pieces of temperature information of the middle region and the end region of the fixing belt 21 detected by the first thermopile 27A and the second thermopile 27B are input to the temperature control unit 54 as temperature information values (voltage values) D1 and D2. In the present embodiment, the relay control unit 54A outputs an on/off control signal $S_1$ to the relay 52 based on the temperature information values D1 and D2 and outputs a drive control signal $S_2$ to a drive control unit 60 of the pressing roller 22, the triac control unit 54B outputs current flow control signals $S_3$ to the triacs 53A and 53B based on the temperature information values D1 and D2, and the over temperature protection circuit 54C outputs an abnormal stop signal $S_4$ to the relay control unit 54A based on the temperature information values D1 and D2. However, this configuration is not restrictive. For example, the triac control unit 54B may output the current flow control signal $S_3$ to the relay 52, and the over temperature protection circuit 54C may output the abnormal stop signal $S_4$ directly to the relay 52 and the drive control unit 60. Also, the over temperature protection circuit 54C may output the abnormal stop signal $S_4$ at the time of an excessive increase in the temperature of the fixing belt 21, and also, of the pressing roller 22 (in this case, a temperature detection signal of the thermistor 29 for detecting the temperature of the pressing roller 22 is also input to the over temperature protection circuit 54C).

When there is a predetermined external operation in a predetermined state where the relay 52 is off, power supply from the power supply unit 51 to the halogen heaters 23A and 23B is stopped, and rotation of the fixing belt 21 and the pressing roller 22 is stopped, the relay control unit 54A maintains the off state of the relay 52 if one or both of the temperature information values D1 and D2 from the first thermopile 27A and the second thermopile 27B are equal to or greater than a predetermined first reference value R1 (D1≥R1 or/and D2≥R1) at the time of the predetermined external operation, and when both of the temperature information values D1 and D2 from the first thermopile 27A and the second thermopile 27B become equal to or less than a predetermined second reference value R2 lower than the first reference value R1 (D1≤R2 and D2≤R2), the relay control unit 54A outputs the on/off control signal $S_1$ to the relay 52, switches on the relay 52, and enables power supply from the power supply unit 51 to the halogen heaters 23A and 23B. Here, the predetermined state mentioned above may be a state where the start-up is stopped with the power of the image forming device 1 turned off, the off-mode or the energy saving mode of the fixing device 20, or a state where the image forming device 1 is suddenly stopped due to jamming of sheets of paper P or other reasons. Also, the predetermined external operation mentioned above may be an operation of turning on the power and restarting the image forming device 1, an operation of instructing the image forming device 1 to form an image (a print job), and an operation of restoring the image forming device 1 from the sudden stop state.

In the present embodiment, the relay control unit 54A performs the process described above by using the temperature information values D1 and D2 input from the first thermopile 27A and the second thermopile 27B, as voltage values as they are without converting the values into temperature values, and then performing comparison and determination with respect to the first reference value R1 and the second reference value R2 that are the voltage values corresponding to the reference temperatures. With this configuration, the process performed by the relay control unit 54A is simplified and sped up. However, this configuration is not restrictive, and control performed by the relay control unit 54A may be performed by converting the temperature information values D1 and D2 input from the first thermopile 27A and the second thermopile 27B into temperature values and then performing comparison and determination for the temperature values with respect to a reference temperature.

Furthermore, in the present embodiment, under the condition described above (D1≥R1 or/and D2≥R1), the relay control unit 54A maintains the off state of the relay 52, and also, outputs the drive control signal $S_2$ to the drive control unit 60 to cause the fixing belt 21 and the pressing roller 22 to rotate (idle rotation). An excessive increase in the local temperature of the fixing belt 21 can thereby be diffused, and time necessary for reaching a state where power supply from the power supply unit 51 to the halogen heaters 23A and 23B is enabled (D1≤R2 and D2≤R2) can be shortened. Here, at the time of causing the fixing belt 21 and the pressing roller 22 to rotate idly, pressure is preferably adjusted such that the fixing belt 21 and the pressing roller 22 are in contact with each other with a pressure which is the same or approximately the same as the pressure on a sheet of paper P passing through the nip portion N. This allows the excessive increase in the local temperature of the fixing belt 21 to be more rapidly diffused.

Figure 5:
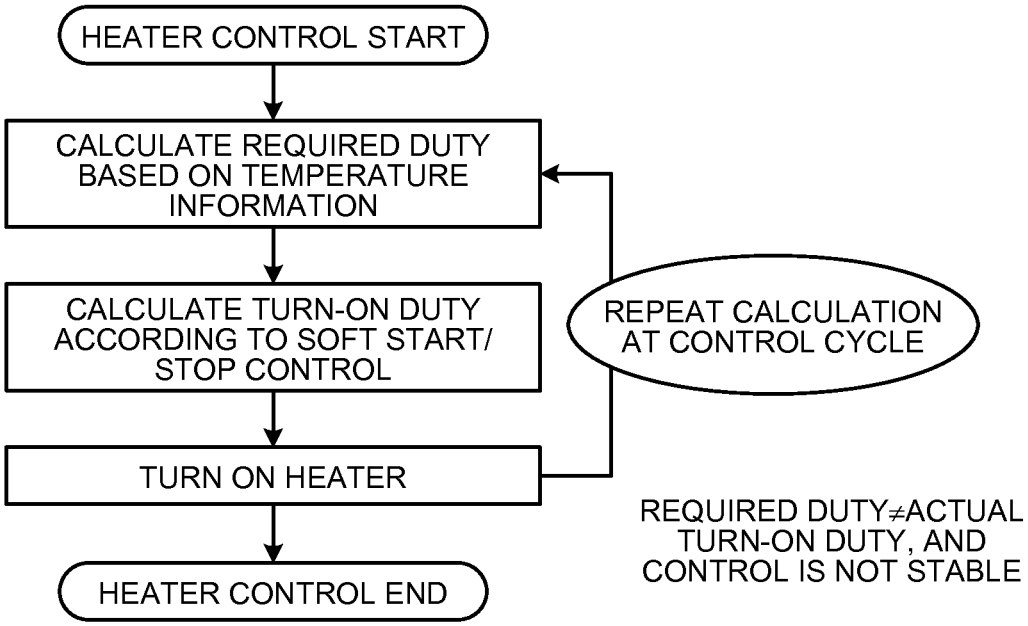
FIG. 5 is a flow chart illustrating an example of a conventional fixing control.
Figure 6:
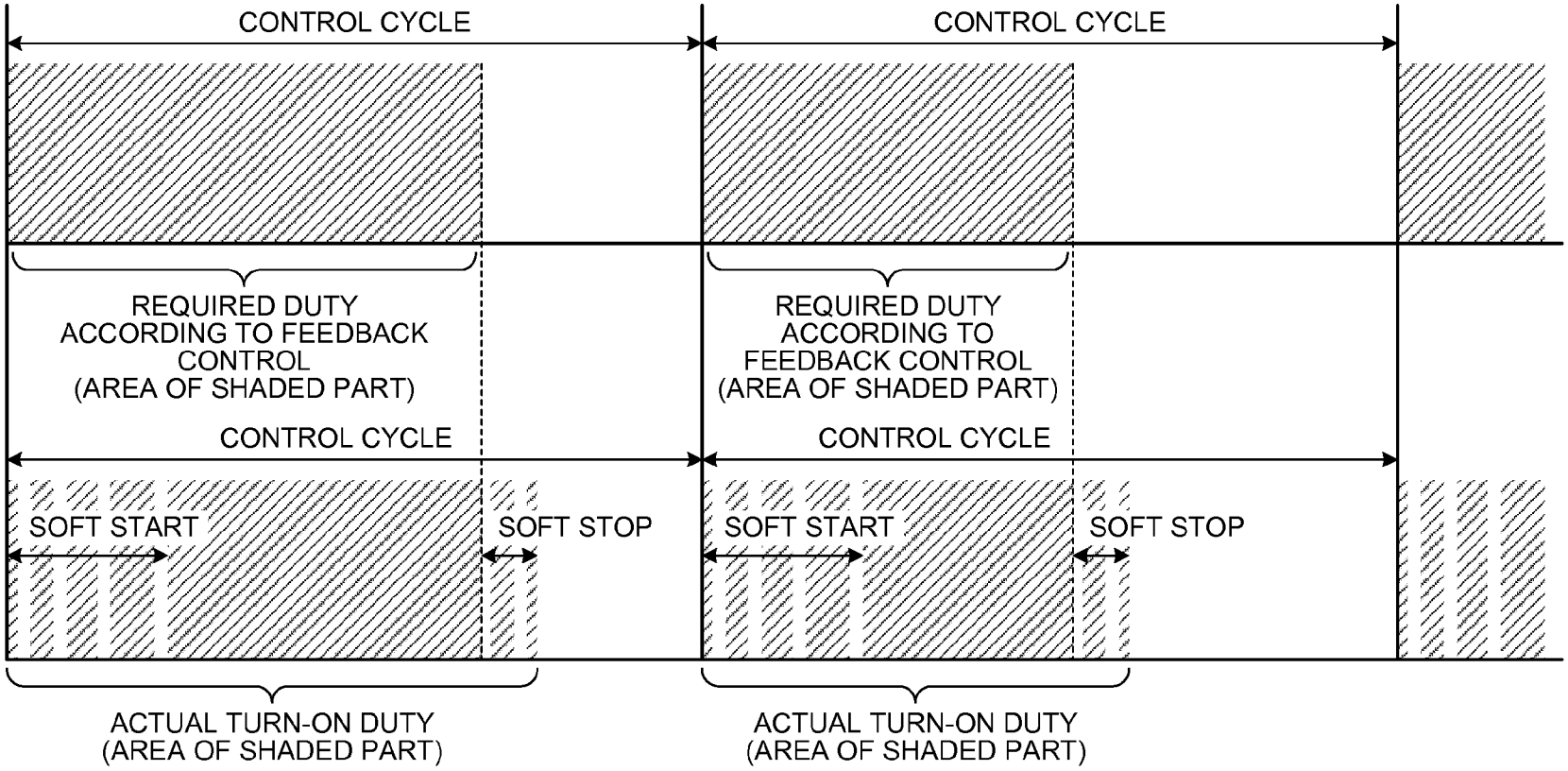
FIG. 6 is a schematic diagram illustrating a heater heating state according to a conventional control.

Now, a conventional fixing control will be described with reference to FIGS. 5 and 6.

In a conventional fixing control, a feedback control is performed based on detection information of a temperature detection unit. Specifically, a conventional fixing control is performed by referring to temperature information at every control cycle (about 400 ms to 1000 ms), then calculating a turn-on period of the heater in the control cycle, and then performing turn-on process according to a soft start/stop control. When using a conventional soft start/stop control, a required turn-on duty according to the feedback control (the area of the shaded part of the required duty according to the feedback control on the upper part in FIG. 6) and an actual turn-on duty (the area of the shaded part of the actual turn-on duty in FIG. 6) do not coincide, and a fixing device using a low heat capacity fixing member may have problems such as poor fixation and uncontrollable temperature. A fixing heater generally needs a specific power supply time to obtain an amount of heat generation that is necessary according to calculation. Thus, an amount of heat necessary for control is hard to obtain in a short power supply time of the soft start/stop control, and therefore, the required turn-on duty and the actual turn-on duty do not coincide. In the case of a halogen heater, about 1.5 seconds is necessary for the output of the heater to become stable after the start of power supply to the heater, due to the time necessary to raise the temperature of the filament or the glass tube. When performing turn-on control of heater in a period shorter than about 1.5 seconds, the calculated required turn-on duty and the actual turn-on duty do not coincide. However, in the conventional fixing device, since the fixing member has a sufficient heat capacity, a minor difference in the amount of heat generation is not likely to be reflected in the surface temperature of the fixing member and does not become a problem.

However, in recent years, a low heat capacity fixing device is desired from the standpoint of increase in the energy saving performance or shortening of warm up time. With a low heat capacity fixing device as described in the present embodiment, since the heat capacity of the fixing member is low and the amount of heat stored is small, the temperature of the surface of the fixing member is easily changed at the time of fixation of toner. That is, the heater turn-on state at the instant of a sheet of paper passing through is highly likely to be the temperature state of the fixing member. Thus, the difference between the actual turn-on duty and the required duty of the heater in the soft start/stop control is allowable (which is not considered a problem) for a conventional fixing device, but is not allowable for the low heat capacity fixing device. As a concrete problem, poor fixation such as a cold offset, a hot offset or the like may occur. Also, since the actual turn-on duty and the required duty according to duty calculation based on the temperature information do not coincide, if an amount of heat generation in the actual turning-on is too much, a problem such as the temperature increasing until a safety device activates may occur. Once the safety device activates, it cannot be deactivated by a user, and a service man has to be called, which results in downtime and lowered productivity.

Accordingly, in the present embodiment, the fixing device performs turn-on control of heater such that the required duty according to the feedback control and the actual turn-on duty according to the soft start/stop control coincide with each other, so as to prevent poor fixation or uncontrollable temperature due to the difference as described above between the required duty and the actual turn-on duty.

That is, this is a control method of calculating a required turn-on duty according to the feedback control (based on the temperature information), then performing conversion by using a correction table to complement a reduced amount of heat in the soft start/stop control, and then actually turning on the heater (controlling power supply to be supplied to the heater according to the corrected actual turn-on duty after complementation). The correction table is a table showing how much the actual turn-on duty is to be changed (increased) in order to cancel the reduced heat amount in the soft start/stop control, with respect to the required turn-on duty. The correction table specifies an actual turn-on duty for each required turn-on duty. For example, in the correction table, the actual turn-on duty of 32% is set for the required turn-on duty of 30%, and the actual turn-on duty of 43% is set for the required turn-on duty of 40%. Of course, a conversion formula (a correction formula) may also be used instead of the correction table.

Note that, since the relationship between the required turn-on duty and the actual turn-on duty is different depending on the control cycle, the voltage input to a heat source, or the frequency (the frequency of alternating current), it is desirable that the correction table or the correction formula be changed depending thereon. Moreover, the correction table is appropriately created in advance by performing a trial experiment in advance. Also, the conversion formula (the correction formula) may be derived from the experiment result.

Figure 7:
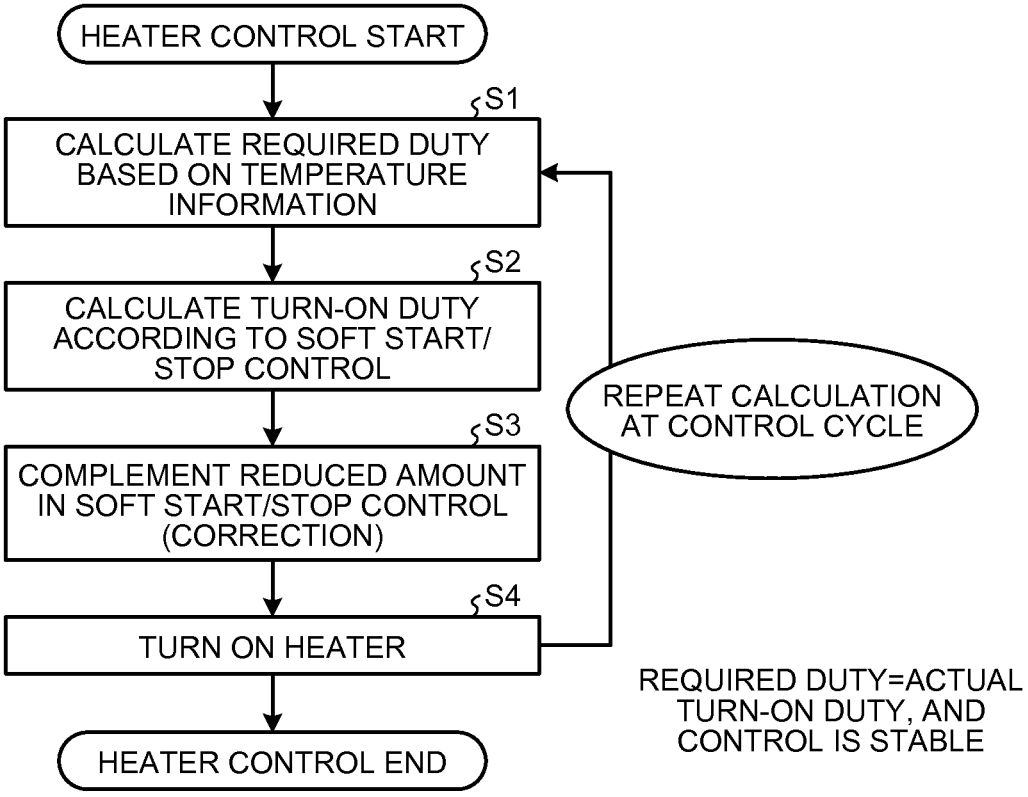
FIG. 7 is a flowchart illustrating a fixing control of the present invention.
Figure 8:
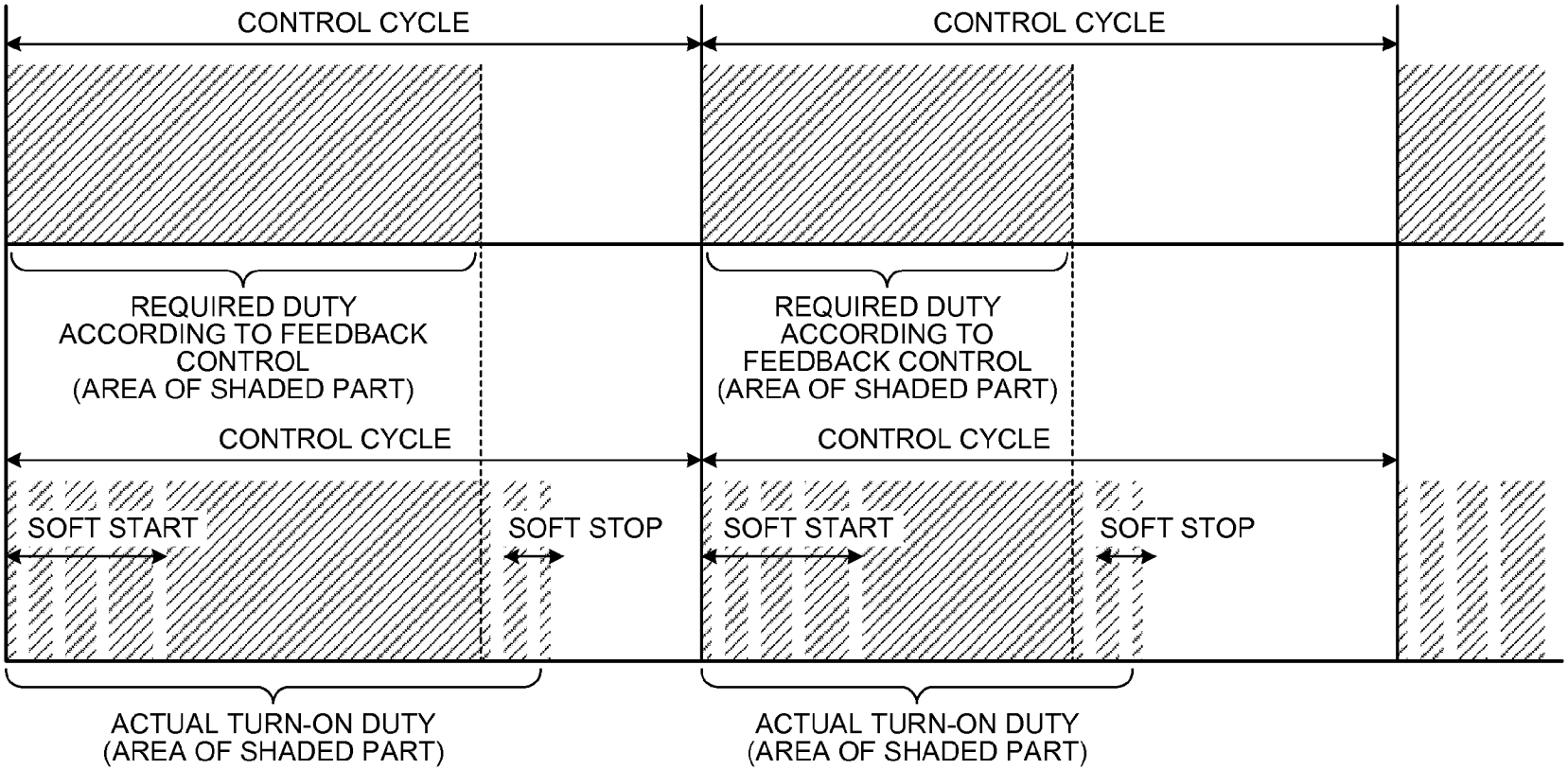
FIG. 8 is a schematic diagram illustrating a heater heating state according to a control of the present invention.

A flowchart of heater control process according to the present invention is illustrated in FIG. 7, and the heating state of a heater is illustrated in FIG. 8.

The heater control method of the present invention is different from the conventional control method in that, at the time of calculating the actual turn-on duty based on the required turn-on duty, correction is add as described above to complement a reduced amount of heat in the soft start/stop control. This is represented in steps S2 and S3. At step S2 in FIG. 7, a turn-on duty according to a soft start/stop control is calculated, and at Step S3, a reduced amount of heat in the soft start/stop control (i.e., a difference between the required turn-on duty calculated at S1 and the turn-on duty calculated at S 2) is complemented. With such a heater control, as illustrated in the schematic diagram in FIG. 8, the (total) area of the shaded part of the actual turn-on duty is made equal to the shaded part of the required turn-on duty, and stable control is achieved. Accordingly, poor fixation such as a cold offset, a hot offset or the like is prevented, and the temperature can be prevented from getting out of control and can be maintained in an appropriate state, and thus, the productivity is not lowered.

Hereinafter, second and third embodiments of the fixing device will be described with reference to FIGS. 9 and 10. Additionally, parts same as those of the fixing device in FIG. 2 will be denoted with the same reference numerals and repeated explanation will be omitted, and only the different parts will be described.

Figure 9:
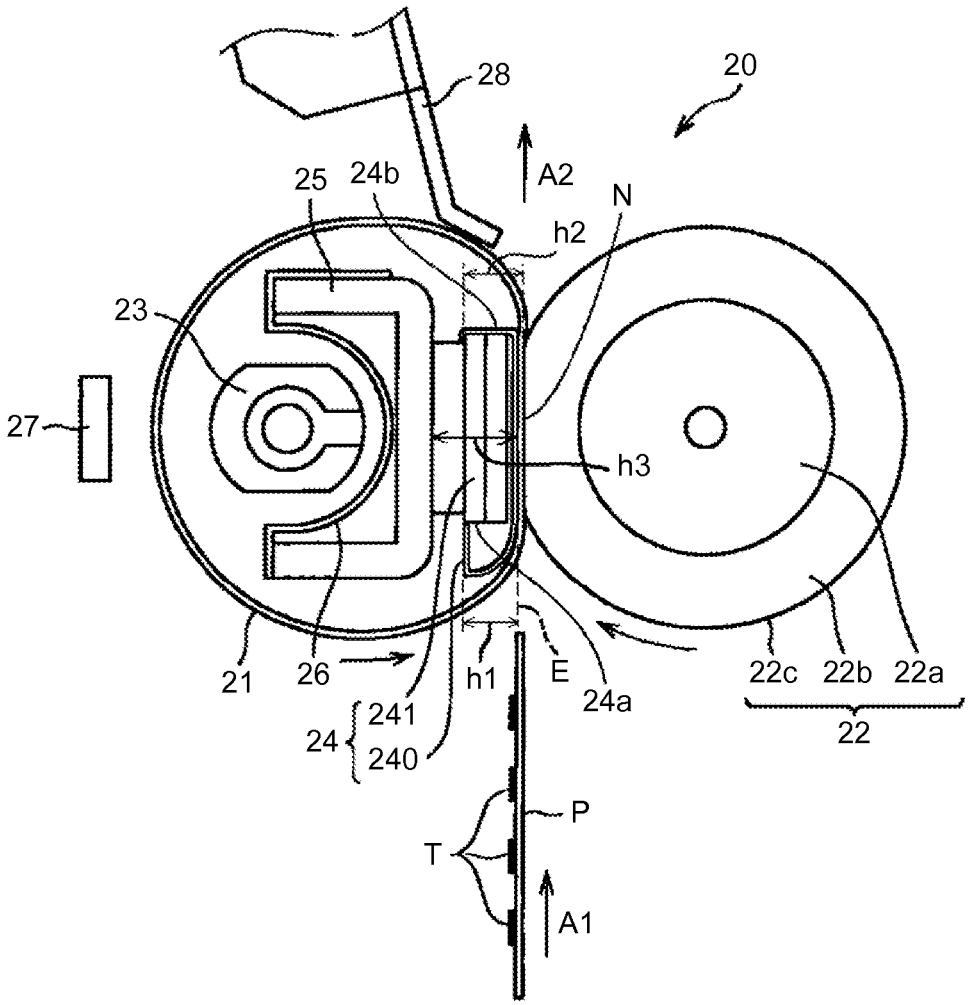
FIG. 9 is a cross-sectional configuration diagram illustrating a second embodiment of the fixing device.

FIG. 9 is a cross-sectional configuration diagram illustrating a second embodiment of the fixing device. The heat source provided to the fixing device of the second embodiment illustrated in the diagram is formed from one halogen heater 23 capable of heating the entire paper passage area of a fixing belt 21 to a predetermined temperature. In the present embodiment, a reflecting member 26 for reflecting the light emitted from the halogen heater 23 has a substantially semicircle shape. A nip forming member 24 includes a base pad 241, and a sliding sheet (a low friction sheet) 240 provided on the surface of the base pad 241.

Figure 10:
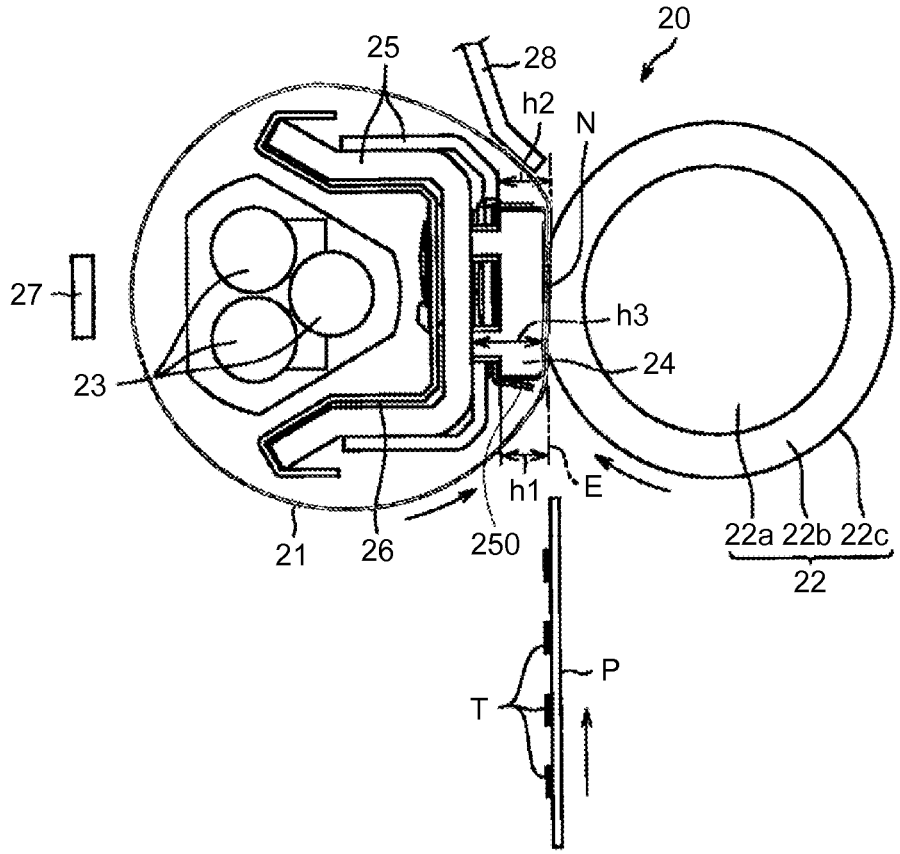
FIG. 10 is a cross-sectional configuration diagram illustrating a third embodiment of the fixing device.

FIG. 10 is a cross-sectional configuration diagram illustrating a third embodiment of the fixing device. The heat source provided to the fixing device of the third embodiment illustrated in the diagram is formed from three halogen heaters 23 heating different areas, and one heater is arranged near the center and two heaters are arranged on the outer sides. The outer portions of a stay 25 and the reflecting member 26 open in a flared shape to match the heater arrangement. Also, a sheet metal 250 is provided surrounding a nip forming member 24, and the nip forming member 24 is supported on the stay 25 via the sheet metal 250.

Heretofore, the present invention has been described with reference to the drawings, but the present invention is not limited thereto. For example, the present invention may be applied to other types of fixing devices such as a belt fixing device that includes a fixing belt suspended between a fixing roller and a heating roller, where a pressing roller is pressed against the fixing roller via the fixing belt, and a SURF fixing device that locally heats only a nip portion using a ceramic heater or the like. Also, with respect to the heat source, an appropriate heat source may be adopted without being limited to a halogen heater. With respect to the material of the fixing belt (including the film), the configuration of the pressing member, and the like, those that are appropriate may be adopted. As a temperature sensor, which is the temperature detection unit, anything that is appropriate, such as a thermopile, a thermistor or the like, may be used.

Also, the configuration of the image forming device is also arbitrary, and the present invention may be applied to a full color device that uses toner of not only four colors, but also three colors, a multi-color device that uses toner of two colors, or a black and white device. Of course, the image forming device is not limited to a printer, and it may be a copier, a fax machine, or an MFP including a plurality of functions.

Also, a case of performing a PWM (Pulse Width Modulation) is described in the embodiments described above, but the present invention may be applied also to a case of performing a PAM (Pulse Amplitude Modulation) control if there is a difference between an actual amount of heat in actually turning on the heater and a necessary amount of heat that is necessary according to calculation.

According to the present invention, since the actual turn-on duty and the required duty calculated based on the temperature information of a fixing member detected by a temperature detection unit coincide with each other, temperature control is stable and poor fixation such as a cold offset, a hot offset or the like can be prevented. Also, an appropriate state can be maintained by preventing temperature from getting out of control, and thus, the productivity can be prevented from being lowered.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device for conveying a recording medium carrying an unfixed image and fixing the unfixed image on the recording medium, the fixing device comprising:

a rotatable fixing member;

a rotatable pressing member that is in press contact with the fixing member to form a nip portion;

a heat source that heats the fixing member;

a temperature detection unit that detects a temperature of the fixing member; and a temperature control unit configured to control power supply to the heat source based on temperature information input from the temperature detection unit, wherein:

the temperature control unit is configured to control turn-on period of the heat source at an initial time period after start of the power supply and at an ending time period before end of the power supply to gradually change a temperature of the fixing member, the fixing device has a correction table or a correction conversion formula to correct a difference between a necessary amount of heat and an actual amount of heat, the necessary amount of heat being an amount of heat necessary, according to calculation, for controlling the fixing member to be a predetermined temperature, and the actual amount of heat being an amount of heat in actually turning on the heat source according to the control of the turn-on period of the heat source to thereby gradually change the temperature of the fixing device, the temperature control unit is configured to correct, using the correction table or the correction conversion formula, the actual amount of heat or an actual turn-on duty in such a manner that the actual amount of heat or the actual turn-on duty coincides with a required amount of heat or a required turn-on duty that is calculated based on the temperature information, to thereby perform the control of power supply to the heat source according to the corrected actual amount of heat or the corrected actual turn-on duty, and the correction table or the correction conversion formula is changed according to a frequency of an alternating current input to the heat source.

2. The fixing device according to claim 1, wherein the correction table or the correction conversion formula is changed according to a control cycle used for calculation of the required duty.

3. The fixing device according to claim 1, wherein the fixing member is an endless fixing belt, the fixing device includes a nip forming member that is arranged inside the fixing belt and that is in press contact with the pressing member via the fixing belt, and the heat source directly heats the fixing belt at a portion other than the nip portion.

4. An image forming device comprising a fixing device according to claim 1.

5. A fixing device for conveying a recording medium carrying an unfixed image and fixing the unfixed image on the recording medium, the fixing device comprising:

a rotatable fixing member;

a rotatable pressing member that is in press contact with the fixing member to form a nip portion;

a heat source that heats the fixing member;

a temperature detection unit that detects a temperature of the fixing member; and a temperature control unit configured to control power supply to the heat source based on temperature information input from the temperature detection unit, wherein:

the temperature control unit is configured to control turn-on period of the heat source at an initial time period after start of the power supply and at an ending time period before end of the power supply to gradually change a temperature of the fixing member, the fixing device has a correction table or a correction conversion formula to correct a difference between a necessary amount of heat and an actual amount of heat, the necessary amount of heat being an amount of heat necessary, according to calculation, for controlling the fixing member to be a predetermined temperature, and the actual amount of heat being an amount of heat in actually turning on the heat source according to the control of the turn-on period of the heat source to thereby gradually change the temperature of the fixing device, the temperature control unit is configured to correct, using the correction table or the correction conversion formula, the actual amount of heat or an actual turn-on duty in such a manner that the actual amount of heat or the actual turn-on duty coincides with a required amount of heat or a required turn-on duty that is calculated based on the temperature information, to thereby perform the control of power supply to the heat source according to the corrected actual amount of heat or the corrected actual turn-on duty, and the correction table or the correction conversion formula is changed according to a voltage input to the heat source.

6. The fixing device according to claim 5, wherein the correction table or the correction conversion formula is changed according to a control cycle used for calculation of the required duty.

7. The fixing device according to claim 5, wherein the fixing member is an endless fixing belt, the fixing device includes a nip forming member that is arranged inside the fixing belt and that is in press contact with the pressing member via the fixing belt, and the heat source directly heats the fixing belt at a portion other than the nip portion.

8. An image forming device comprising a fixing device according to claim 5.

* * * * *